US006352187B2

(12) United States Patent
Strode

(10) Patent No.: US 6,352,187 B2
(45) Date of Patent: Mar. 5, 2002

(54) GOLF BAG FOR CARRYING CLUBS DURING PLAY

(76) Inventor: Wayne Strode, P.O. Box 42, Woodbury, CT (US) 06798

( * ) Notice: Subject to any disclaimer, the term of this patent is extended or adjusted under 35 U.S.C. 154(b) by 0 days.

(21) Appl. No.: 09/681,653

(22) Filed: May 16, 2001

Related U.S. Application Data

(60) Provisional application No. 60/207,175, filed on May 26, 2000.

(51) Int. Cl.[7] ..... A45C 1/04

(52) U.S. Cl. ..... 224/664; 224/640; 224/641; 206/315.6; D3/255; D3/320

(58) Field of Search ..... 224/645, 660, 224/663, 664, 637, 640, 641, 653; 206/315.3, 315.6; D3/255, 320

(56) References Cited

U.S. PATENT DOCUMENTS 4,182,470 A * 1/1980 Atkinson
4,844,253 A * 7/1989 Reimers
5,419,473 A * 5/1995 Lamar
5,651,486 A * 7/1997 Kliot
5,950,889 A * 9/1999 Feldman, Jr.
5,954,253 A * 9/1999 Swetish
6,024,265 A * 2/2000 Clements
6,182,874 B1 * 2/2001 Feldman, Jr.

OTHER PUBLICATIONS

Hang tag from the Maxfli Belt Bag.

* cited by examiner

*Primary Examiner*—Gregory M. Vidovich
(74) *Attorney, Agent, or Firm*—William C. Crutcher

(57) ABSTRACT

A light weight golf bag with waist straps and an angle adjustment cord which is carried on the waist at an angle behind the players' back, so as not to impede the players' stroke. The bag is not intended to be removed between shots.

12 Claims, 3 Drawing Sheets

GOLF BAG FOR CARRYING CLUBS DURING PLAY

CROSS REFERENCE TO RELATED APPLICATIONS

This application claims the benefit of prior filed co-pending provisional application serial No. 60/207,175 filed May 26, 2000.

BACKGROUND OF INVENTION

This invention relates generally to accessories used in playing golf, and more particularly to an improved golf bag for carrying clubs during play.

It is well known that the game of golf requires carrying an assortment of golf clubs, which are selectively used during the game. These are normally carried in a golf bag which is transported on a golf cart, wheeled along in a golf cart by the player, or carried over the shoulder with a shoulder strap attached to the golf bag. In the latter case, much time and effort are consumed by disengaging the golf bag, selecting a club, laying the bag down, striking the ball, picking up the bag, inserting the club, and replacing the bag on the shoulder with the shoulder strap. Bending over and picking up the bag may lead to lower back problems, and carrying the bag with a shoulder strap may lead to shoulder pain from carrying the bag. If a few clubs are removed and carried separately, this leads to the possibility of forgetting and leaving a club between shots.

The rules of golf permit an assortment of any desired number of clubs up to a maximum limit on the number of clubs, and most players use only a few favorite clubs during play. Also, par three courses generally require fewer clubs and it is desirable to use fewer clubs to increase the speed of play. Also, the play would be speeded up if the player could walk directly to the ball rather than stopping to select and remove a club.

Accordingly, one object of the present invention is to provide an improved golf bag that is light and portable and designed to be carried without removal while playing golf, as well as capable of being carried over the shoulder in a conventional fashion.

Another object of the invention is to provide an improved golf bag, which imposes no weight on the shoulders and requires no awkward bending to lift a heavy golf bag full of clubs.

Another object of the invention is to provide an improved golf bag which makes walking unnecessary to retrieve the bag between shots and which speeds up play on the golf course.

Still another object of the invention is to provide an improved golf bag for carrying about the course, which reduces the amount of walking and lifting during the game of golf and reduces the possibility of lost clubs.

SUMMARY OF INVENTION

Briefly stated, the invention is practiced by providing a golf bag adapted for a player to continuously carry along with a set of golf clubs while playing golf, the golf clubs each having a longitudinal shaft attached to a club head, said golf bag comprising: a longitudinal carrier body having a top end, an intermediate section and a bottom end, said carrier body defining a plurality of longitudinal passages which are open at the carrier body top end for receiving the shafts of the golf clubs with the club heads protruding, a carrier waist strap having first and second waist strap portions, each waist strap portion having one end attached to the carrier body and also having a free end, and clip means for attaching together said free ends about the waist of said player, and a carrier angle adjustment member attached between said carrier waist strap and the bottom end of the carrier body, said carrier angle adjustment member being arranged for selective lengthening or shortening to adjust the angle of the golf bag on the waist of the player.

BRIEF DESCRIPTION OF DRAWINGS

The invention will be better understood by reference to the following description, taken in connection with the accompanying drawings, in which.

DETAILED DESCRIPTION OF THE PREFERRED EMBODIMENT

Figure 1:
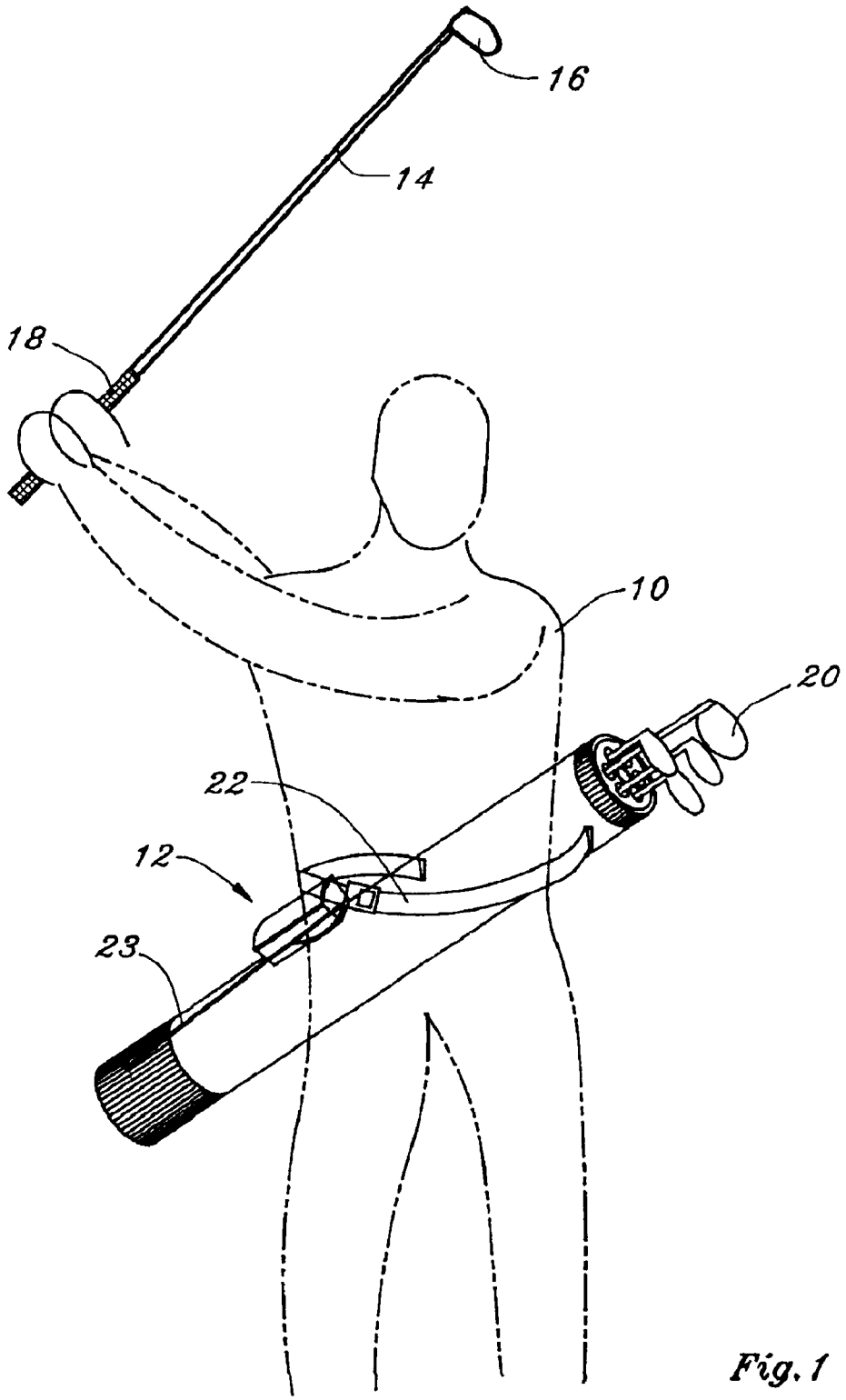
FIG. 1 is a perspective elevational view showing a golfer playing golf while carrying the improved golf bag.
Figure 5:
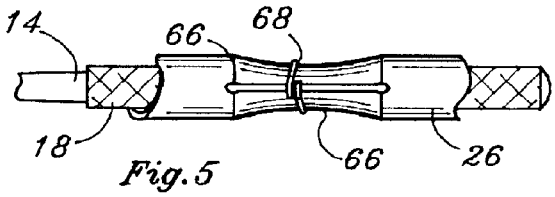
FIG. 5 is an enlarged partial elevational view, illustrating the preferred construction for retaining club shafts in the bag.

Referring to FIG. 1 of the drawing, a golf player 10 is carrying a golf bag 12 around his waist. The player 10 is using a conventional golf club having a longitudinal shaft 14, with a club head 16 on one end and an enlarged grip 18 on the other. The golf bag 12 holds a small but adequate selection of additional clubs shown collectively at 20, with the club heads protruding from the bag. Player 10 carries the bag 12 around his waist and disposed at an angle as indicated in the drawing, by means of a carrier waist strap 22 and a waist strap adjustment member 23.

Figure 4:
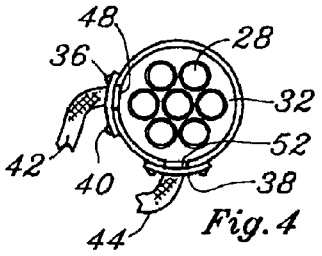
FIG. 4 is an enlarged plan view, in cross section, taken along lines IV—IV of FIG. 3.
Figure 2:
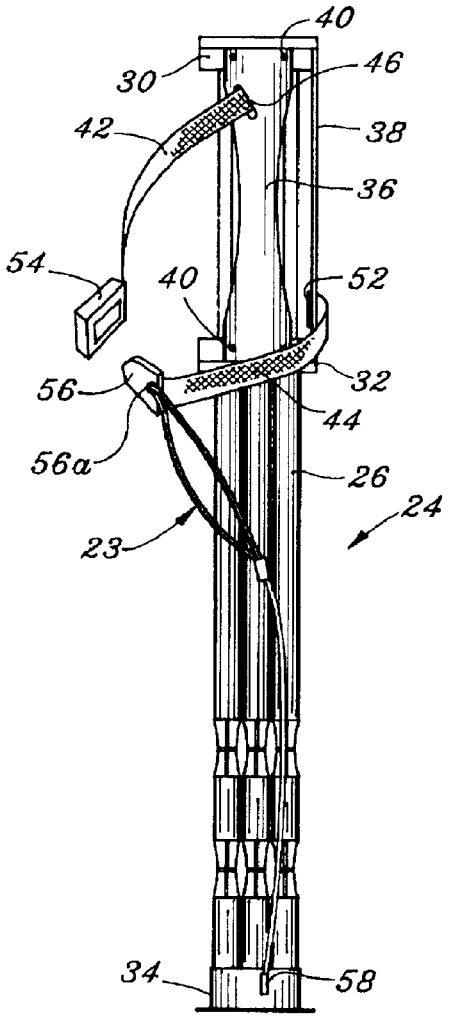
FIG. 2 is a front elevational view of the carrier body with attachment straps but without the fabric shell.
Figure 3:
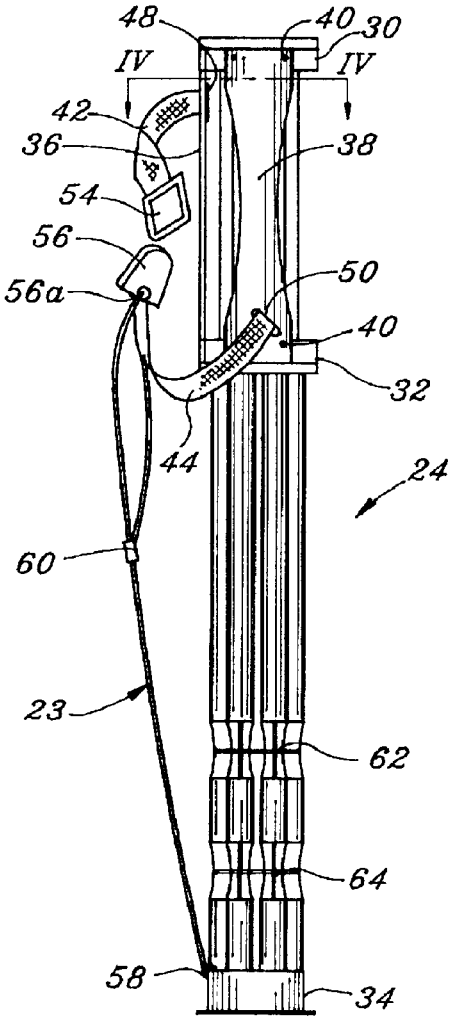
FIG. 3 is a side elevational view, rotated 90 degrees from the view of FIG. 2.

Further details of the internal structure of golf bag 12 may be seen by reference to FIGS. 2–5 of the drawing. FIGS. 2 and 3 illustrate two elevational views of a carrier body 24 with the external fabric shell removed. The carrier body is made up of a circular assembly of tubular members, such as the one illustrated at 26. Tubular members 26 are preferably of lightweight plastic material. In the embodiment shown there are seven such tubular members 26. There could be a smaller or a larger number of tubular members, but there should be enough to carry a reasonable number of clubs without having so many that the golf bag becomes unduly heavy. Inside each of the tubes 26 is longitudinal passage 28, as shown in FIG. 4, for receiving the grip 18 and longitudinal shaft 14 of a golf club.

In order to hold the circular assembly in position, a first annular tube guide 30 is located at a top end of the carrier body 24; a second annular tube guide 32 is located at an intermediate section of the carrier body, about ⅓ along the length thereof from the top end; and a third annular tube guide 34 is disposed at the bottom end of the carrier body. The bottom end annular or tube guide 34 may conveniently be a cup-shaped receptacle with spacing means, such as an array of stubs, to hold the bottoms of the tubular members 36 in position. The second annular tube guide 32 located at the intermediate section may be a disk with a matching array of holes for receiving the tubular members 26. The first annular tube guide 30 at the top end may comprise a similar disk with a matching array of holes receiving the top ends of the tubular members.

The first and second annular tube guides 30, 32 are longitudinally spaced from one another by means of a pair of longitudinal spacer members 36, 38. Spacers 36, 38 are circumferentially displaced from one another by 90 degrees and attached by suitable means, such as rivets 40, to the tube guides 30, 32. FIG. 3 is rotated 90 degrees in the drawing around the longitudinal axis from the view of FIG. 2, so that the front and side views of the longitudinal spacers 36, 38 may be seen in each of the views.

The waist band strap 22 (FIG. 1) is preferably made up of a first waist strap portion 42 and a second waist strap portion 44. Waist strap portion 42 is attached to longitudinal spacer 36 near the top end of the carrier body by means of an angled slot 46 in spacer 36 (FIG. 2) and a stop member 48 (FIG. 3). Waist strap portion 44 is attached to longitudinal spacer 38 by means of an angled slot 50 in the spacer near the intermediate section (FIG. 3), and an internal stop 52 (FIG. 2).

Strap portion 42 has a free end with a female clip receptacle 54; waist strap portion 44 has a mating male clip tab 56. The slots 46 and 50 for attaching the waist strap portions are both longitudinally and circumferentially spaced from one another as seen from the drawings.

Reference to FIG. 4 of the drawing, which is a cross section through the carrier body and longitudinal spacers 36, 38, shows the details of the annular tube guide 32, the longitudinal passages 28 along the carrier body inside the tubes, and the details for attachment of waist strap portions 42, 44 to longitudinal spacers 36, 38 respectively.

In order to adjust the angle of the golf bag on the player, the invention includes a carrier angle adjustment member 23. This comprises a flexible cord attached at one end to the lower annular tube guide 34, as seen at 58, and looped through an eyelet 56*a* in clip 56, to terminate within a releasable and slidable friction adjustment clasp 60. Many alternate adjustment systems are possible and well known to those skilled in the art to lengthen or shorten the distance between carrier clip 56 and attachment point 58 at the bottom end of the carrier body. While the carrier angle adjustment member 23 is shown as being attached to the clip member 56, it can also be attached to a separate clip slidable along the waist belt portion 44.

In order to keep the golf clubs from sliding out of the open ends of the tubular members, the preferred embodiment of the invention employs means for gripping the longitudinal shafts of the golf clubs. The gripping means illustrated in the FIGS. 2 and 3 are shown as a pair of resilient constrictions in each of the tubes, one pair of such resilient constrictions being shown at 62 and 64. The enlarged partial view of FIG. 5 of the drawing shows a section of longitudinal tubular member 26 provided with longitudinal slits 66. These enable the walls of the tubular member to be drawn in by an encircling member 68 of spring metal as apparent from the drawing. When the club shaft 14 is inserted, the enlarged grip 18 is frictionally gripped by the spring ring 68.

Alternate Carrier Body Construction

Figure 6:
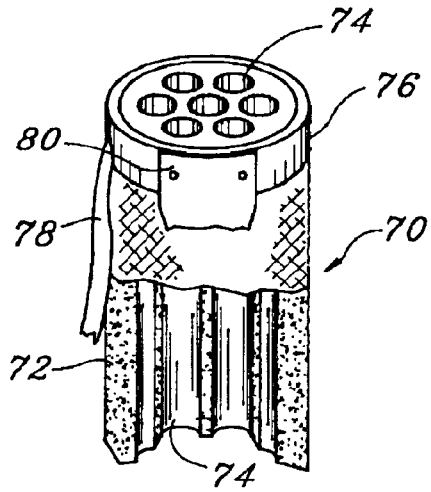
FIG. 6 is a partial perspective view illustrating an alternate form of the invention.

FIG. 6 illustrates an alternate construction for a carrier body shown generally at 70. A cylindrical member 72 of lightweight foam is molded using internal mandrels, which are removed to provide a circular array of longitudinal passages 74. A reinforcing ring 76 at the top end of the carrier body 70 and a similar ring (not shown) in the intermediate section are spaced and located by longitudinal spacer members 78, 80, as before. The remainder of the details are the same as those shown in the preferred embodiment, except for the gripping means. The latter may be provided by suitably contoured leaf spring members (not shown) inside the bottoms of the longitudinal passages 74.

Figure 7:
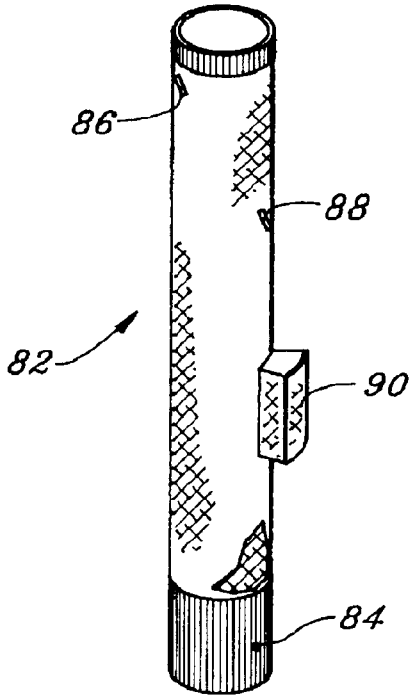
FIG. 7 is a perspective view showing the fabric shell used in connection with the improved golf bag.

In FIG. 7, a fabric shell is illustrated, which adds a conventional appearance to the golf bag. The fabric shell, shown generally at 82 is dimensioned to fit tightly around the carrier body 24 of FIGS. 2 and 3 or 70 of FIG. 6. A hole 84 near the bottom end, a slot 86 near the top end and a slot 88 at an intermediate section permit the passage of the waist strap portions 42, 44 and the angle adjustment member 23. The fabric shell 82 may be provided with conventional embellishments such as tee and ball holder bag 90 and, if desired, may include a club head cover (not shown) attached in a conventional fashion.

As an alternative to attaching the waist strap portions 42, 44 and the angle adjustment member 23 to the carrier body and running them through openings 84, 86, 88 in the fabric shell, the members 42, 44 and 23 may be attached directly to the fabric shell 82. In this case, attachment means comprising pieces of material with attached clips or eyelets (not shown) are sewn to the fabric at the same locations as openings 84, 86, 88 shown in FIG. 7. In either case, the strap portions 42, 44 and the angular adjustment member 23 would be attached to and serve to support, and adjust the angle of, the golf bag.

Figure 8:
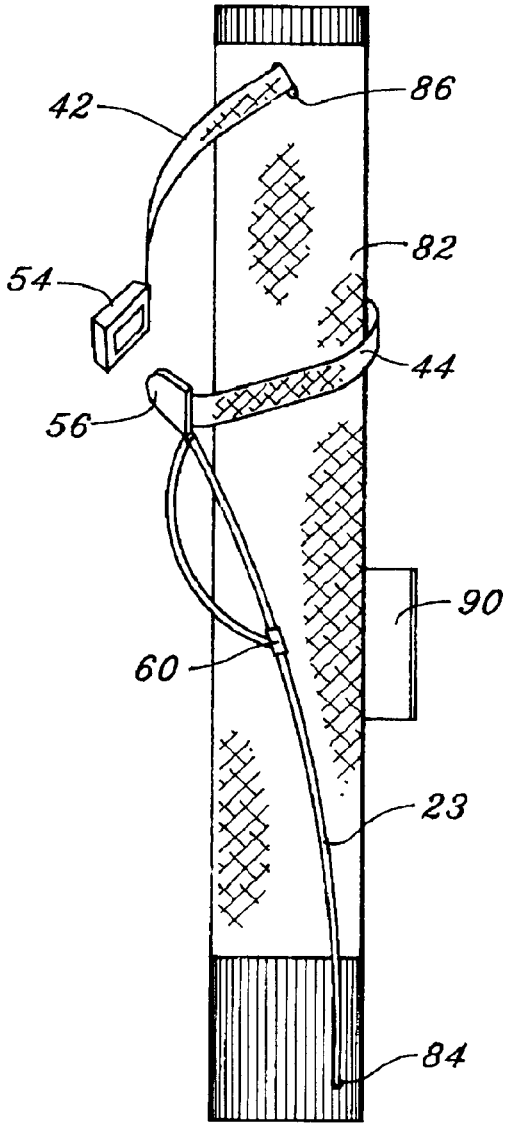
FIG. 8 is an elevational view of the improved golf bag with fabric shell.

FIG. 8 illustrates the improved golf bag with the carrier body disposed inside the fabric cover 82 and having the outer appearance of a conventional golf bag, with the exception of the waist attachment belt and angle adjustment member and the circular array of openings for the insertion of golf club handles on the top end. Because the attachment points of the two waist straps to the bag are both longitudinally and circumferentially spaced from one another, the bag assumes an angle as shown in FIG. 1 when attached around the waist. The angle may be adjusted with the angle adjustment member by shortening or lengthening the member 23 with the clasp 60.

Industrial Applicability

Because of its light weight and construction adapted for carrying about the waist of the player, the improved golf bag can be carried while actually addressing the ball and striking the ball without ever removing the bag from the waist. Contrary to other club carrying systems, the improved golf bag speeds up play and makes it easier to walk the golf course with no weight on the shoulders from the golf bag strap. No awkward bending is required to lift a heavy golf bag and it is never necessary to leave and then later retrieve a golf club. A personalized selection of desired golf clubs can be carried. The carrier can be provided with interchangeable machine washable fabric shells.

While there has been described what is considered to be the preferred embodiment of the invention, other modifications will become apparent to those skilled in the art, and it is desired to secure in the appended claims all such modifications as followed within the free and scope of the invention.

What is claimed is:

1. A golf bag adapted for a player to continuously carry along with a set of golf clubs while playing golf, the golf clubs each having a longitudinal shaft attached to a club head, said golf bag comprising:

a longitudinal carrier body having a top end, an intermediate section, and a bottom end, said carrier body defining a plurality of longitudinal passages which are open at the carrier body top end for receiving the shafts of the golf clubs with the club heads protruding, a carrier waist strap having first and second waist strap portions, each waist strap portion having one end attached to the golf bag and also having a free end, wherein said one ends of said strap portions attached to said golf bag are longitudinally spaced from each other, clip means connected to said free ends for attaching together said free ends about the waist of said player, and a carrier angle adjustment member attached between said carrier waist strap and the bottom end of the golf bag, said carrier angle adjustment member being arranged for selective lengthening or shortening to adjust the angle of the golf bag on the waist of the player.

2. The golf bag according to claim 1, wherein said first waist strap portion is attached near the top end of the carrier body and wherein the second strap portion is attached near said intermediate section of the carrier body.

3. The golf bag according to claim 1, wherein said clip means comprises first and second separable clips attached to the respective free ends of the first and second waist strap portions, and wherein the carrier angle adjustment member is attached between one of said waist strap portions and the bottom end of the golf bag.

4. The golf bag according to claim 1, wherein the carrier body comprises an assembly of spaced lightweight tubular members, each said tubular members defining one of said longitudinal passages.

5. The golf bag according to claim 1, wherein the carrier body comprises a plastic foam body defining therein said plurality of longitudinal passages.

6. The golf bag according to claim 1, and further including a first annular tube guide disposed on the top end of the carrier body, a second annular tube guide disposed at said intermediate section of the carrier body, spacer means separating said first and second annular tube guides, said first and second strap portions being attached to the spacer means.

7. The golf bag according to claim 6, wherein said spacer means comprises a pair of circumferentially spaced longitudinal spacer members connected to and spacing said annular tube guides, said first and second waist strap members being connected to respective slots on said spacer members at longitudinally and circumferentially spaced locations.

8. The golf bag according to claim 1, and further including a fabric shell surrounding the carrier body.

9. The golf bag according to claim 8, wherein the fabric shell has openings therein to permit attachment of the first and second strap portions and the carrier angle adjustment member to the carrier body.

10. The golf bag according to claim 8, wherein the fabric shell has attachment means thereon to permit attachment of the first and second strap portions and the angular adjustment member to the fabric shell.

11. The golf bag according to claim 1 including gripping means comprising a resilient constricting passage in each of said longitudinal passages to resist tendency of the shafts to slide out of the longitudinal passages when the golf bag is inverted.

12. The golf bag according to claim 11 wherein the carrier body comprises an assembly of spaced lightweight plastic tubular members, each said tubular member defining one of said longitudinal passages, and wherein said resilient constricting passage in each of said tubular members comprises at least one longitudinal slit in the tubular member and a spring ring encircling said longitudinal slit.

* * * * *